US006412687B1

(12) United States Patent
Steitz

(10) Patent No.: US 6,412,687 B1
(45) Date of Patent: Jul. 2, 2002

(54) PRESSURE SEAL C-Z FOLD MAILER WITH BUILT-IN RETURN ENVELOPE

(75) Inventor: Jeremy W. Steitz, Cedar Rapids, IA (US)

(73) Assignee: Moore North America, Inc., Stamford, CT (US)

( * ) Notice: Subject to any disclaimer, the term of this patent is extended or adjusted under 35 U.S.C. 154(b) by 0 days.

(21) Appl. No.: 09/906,841

(22) Filed: Jul. 18, 2001

(51) Int. Cl.[7] ..... B65D 27/06
(52) U.S. Cl. ..... 229/305; 229/92.1
(58) Field of Search ..... 229/305, 92.1, 229/304, 92.3, 313, 316

(56) References Cited

U.S. PATENT DOCUMENTS

| | | | | |
|---|---|---|---|---|
| 3,184,150 A | * | 5/1965 | Hubbard | 229/305 |
| 3,228,586 A | * | 1/1966 | Hayes, Jr. | 229/305 |
| 3,507,519 A | * | 4/1970 | NcNabb | 229/305 X |
| 3,977,597 A | * | 8/1976 | Wise et al. | 229/305 |
| 4,575,121 A | | 3/1986 | Conti | |
| 4,585,160 A | | 4/1986 | Fiske, II | |
| 4,799,618 A | | 1/1989 | Jenkins | |
| 4,918,128 A | | 4/1990 | Sakai | |
| 5,174,491 A | | 12/1992 | Taylor et al. | |
| 5,174,493 A | | 12/1992 | File | |
| 5,201,464 A | | 4/1993 | File | |
| 5,253,798 A | | 10/1993 | Lombardo | |
| 5,289,972 A | | 3/1994 | Sauerwine | |
| 5,314,110 A | | 5/1994 | Lombardo | |
| 5,346,123 A | | 9/1994 | Lombardo | |
| 5,366,145 A | | 11/1994 | Sauerwine | |
| 5,375,764 A | | 12/1994 | Sauerwine | |
| 5,402,934 A | | 4/1995 | Sauerwine | |
| 5,464,255 A | * | 11/1995 | Schildmeyer | 229/305 X |
| 5,513,795 A | | 5/1996 | Sauerwine | |
| 5,553,774 A | | 9/1996 | Goodno | |
| 5,752,647 A | * | 5/1998 | Schubert et al. | 229/305 X |
| 5,785,242 A | | 7/1998 | Lombardo | |
| 5,829,670 A | | 11/1998 | Lombardo et al. | |

FOREIGN PATENT DOCUMENTS

| | | | |
|---|---|---|---|
| FR | 57.283 | * 12/1952 | 229/92.1 |
| GB | 6078 | * of 1911 | 229/92.1 |
| WO | WO 92/22431 | 12/1992 | |

OTHER PUBLICATIONS

Standard Register Corporation Jury Form for New Jersey, Admitted Prior Art. No Date.
U. S. application No. 09/482,875, filed Jan. 14, 2000.

* cited by examiner

*Primary Examiner*—Jes F. Pascua
(74) *Attorney, Agent, or Firm*—Nixon & Vanderhye PC

(57) ABSTRACT

An intermediate for a mailer type business form is provided that is C-Z folded to produce a mailer type business form with built-in reply envelope. An area is provided for printing statement, remittance and/or other information and yet the reply envelope produced accepts a conventional size personal check without folding. This is accomplished by providing a four panel from having two panels that define the reply envelope, one panel that defines invoicing and/or remittance stubs and one panel for defining the outgoing mailer top face.

14 Claims, 4 Drawing Sheets

PRESSURE SEAL C-Z FOLD MAILER WITH BUILT-IN RETURN ENVELOPE

BACKGROUND AND SUMMARY OF THE INVENTION

Mailer type business forms must serve a wide variety of customer requirements. Several features that are almost universally desirable include block out for added security, a built-in reply envelope that accepts a conventional size personal check without folding, a statement portion, and a remittance coupon or stub portion for being returned along with the check remittance.

Fourteen-inch, pressure seal Z-fold built-in return envelope products are conventionally imaged on a laser printer in the simplexed mode (one side only). From a print processing standpoint, this is an advantage. However, because the document is simplexed, there is not much space available for variable imaging. These areas generally include room for a statement or invoice, room for a remittance coupon or stub portion, and room to create the return envelope. With conventional three panel documents, one panel is used for the outgoing address panel and the two remaining panels are used to meet the remaining requirements of the mailer. More specifically, on conventional existing pressure seal Z-fold return constructions, the face of the top panel is generally used for both the remittance and the statement or invoice, the middle panel is used to create one side of the return envelope and the bottom is used to create the second side of the return envelope. Pressure seal adhesive or co-adhesive is provided on one and/or the other of the middle panel and bottom panel so that when the Z-fold mailer is formed, the return envelope is simultaneously created. Accordingly, to remit payment, the customer removes the combined statement/remittance portion, severs the remittance stub and inserts it in the reply envelope together with the personal check remittance. A re-wettable adhesive is typically provided on the reply envelope flap, which is folded to the back of the reply envelope to seal the remittance therein.

In the above-described 14 inch, Z-fold return mailer construction, the bottom panel serves a dual purpose. It bears the outgoing address and the side having the outgoing address defines the backside of the return envelope when the mailing is Z-folded. As a result, however, part of the outgoing address is visible on the backside of the return envelope. Some Z-fold mailers have been configured to minimize or eliminate the exposed outgoing address. For example, U.S. Pat. No. 5,513,795, the entire disclosure of which is incorporated herein by this reference, provides a construction wherein part of the outgoing address is removed by tearing along a line of weakness and the remaining portion of the outgoing address is obscured or covered when the reply envelope is sealed. Nevertheless, with this and other conventional Z-folds, the return mailer envelope is generally a side open construction or side sealing envelope construction. A top open or top sealing construction is not possible with this pressure Z-fold construction simply because there is a lack of space.

It would therefore be desirable to provide an intermediate for a business form mailer that may be simplex printed, that provides a return envelope that includes address information on only the front face thereof to avoid post office confusion, and that provides a top open/sealing return envelope construction for increased customer acceptance, and finally that can accommodate a personal check in the return envelope without folding.

According to the present invention, an intermediate for a mailer type business form and the mailer itself are provided which achieves the objectives set forth above. The intermediate comprises a single quadrate sheet of paper, which may be easily run through a printer to print indicia on either one or both faces. In an exemplary embodiment, the outgoing address and the reply address are printed on different faces of the intermediate and thus where adapted to printing in the simplexed mode, only the outgoing address is variably printed. The intermediate may be easily C-Z-folded to form the final mailer and sealed by conventional techniques. The mailer is easy to open and the reply envelope is easy to utilize.

According to an embodiment of the invention, the face of the document has four equal panels, one panel, for example the top panel, is provided as the face of the outgoing mail piece. A second face of the first panel preferably has block out for added security. In the alternative, the back face may have preprinted advertisement or instructional indicia. A second panel, for example, one of two intermediate panels is provided to define the invoice being sent to the end user and includes a copy for the user to retain and a copy for being returned. The back or second face of the second panel may provide additional instructions, a form for completing change of address information or block out for added security. The second panel advantageously includes a right angle perforation to facilitate separation of the customer copy of the invoice from the remittance copy for being returned with the end user's payment. The second panel also has an extra parallel perforation for defining a closure flap for the return envelope. A third panel, for example, the second intermediate panel advantageously contains block out on the first face thereof for defining the inside of a preconstructed return envelope. The back of this panel may have block out for additional security for both the original outgoing mail piece as well as for the returned envelope. In the alternative, the back of this panel may include advertising or other informational indicia. A fourth panel, for example, the bottom panel has block out on the first face thereof for defining the inside of the return envelope. The back or second face of this panel is pre-imprinted with the sender's address as a reply address for the outgoing addressee's payment to be mailed back to the sender. The intermediate of the invention is C-Z folded by, starting from the bottom, first folding the fourth panel onto the third panel to form a preconstructed return envelope. The second fold brings the invoice area down over the front of the return envelope and the final fold folds the top panel up to become the outgoing mail piece.

In an exemplary embodiment, the back of the third panel includes opening instructions. Also, preferably at least the side edge panels of the first, top panel includes opening instructions preprinted thereon.

The intermediate for the business form provided according to the invention is imaged in the simplexed mode and then folded and sealed in a conventional manner. When the end user receives the document, the two vertical sides are removed and then the remainder of the document is opened by breaking adhesive regions defined at the top and bottom, using a letter opener, index finger, or the like. The statement is then detached from the document. The recipient fills out the remittance portion and inserts it,.with a check into the return envelope and the envelope is sealed by wetting the adhesive flap of the reply envelope and applying it to the front of the return/reply mail piece.

As is apparent from the foregoing, the invention overcomes a number of barriers and satisfies the requirements of a mailer-type business form. The construction of the invention allows the check to be placed in the return envelope without folding and provides a top open return envelope, which gains wide customer acceptance. Finally, the construction of the invention can be imaged in a simplexed mode, which from a print processing stand point is an advantage, since all variable information can be provided on one face of the intermediate.

Thus, according to one aspect of the present invention, an intermediate for a mailer type business form comprises the following components: a substantially opaque quadrate sheet of paper having parallel top and bottom edges, parallel first and second side edges perpendicular to the top and bottom edges and first and second faces. First, second, and third fold lines are defined parallel to the top and bottom edges and divide the sheet into substantially equal-sized first, second, third, and fourth panels. In the illustrated embodiment, the first panel is defined between the top edge of the intermediate and the first fold line, the fourth panel is defined between the bottom edge and the third fold line, and the second and third panels are defined between the first and fourth panels. An outgoing address is provided on the first face of the first panel. The outgoing address area is of a size and material suitable for receiving outgoing address indicia either by directly printing on the form or by adhesive label application. A reply address area is defined on the second face of the fourth panel. The reply address is typically preprinted on the intermediate but may be variably printed where the mailer is imaged in a duplex mode. Like the outgoing address area, the reply address area is of a size and material suitable for receiving an address printed thereon or the application of an adhesive address label (printed or written).

First and second lines of weakness are formed in the first through fourth panels parallel to and spaced from each of the first and second side edges. These lines of weakness define tear-off strips providing for ready opening of a mailer constructed by C-Z-folding the sheet along the fold lines.

Permanent adhesive patterns are provided on the first face of the third and/or fourth panels, on the second face of the first and/or second panels and on the first face of the second panel and/or second face of the fourth panel for fixedly adhering the mailer in a folded configuration when the first, second, third and fourth panels are C-Z folded about the first, second, and third fold lines. Another permanent adhesive pattern, preferably including dots or strips of adhesive is disposed on the second face of the first panel adjacent the top edge thereof and/or on the second face of the second panel along and adjacent the second fold line and further on the first face of the second panel adjacent the first fold line and/or on the second face of the fourth panel adjacent the third fold line for securing the top and bottom edges of the C-Z folded mailer.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
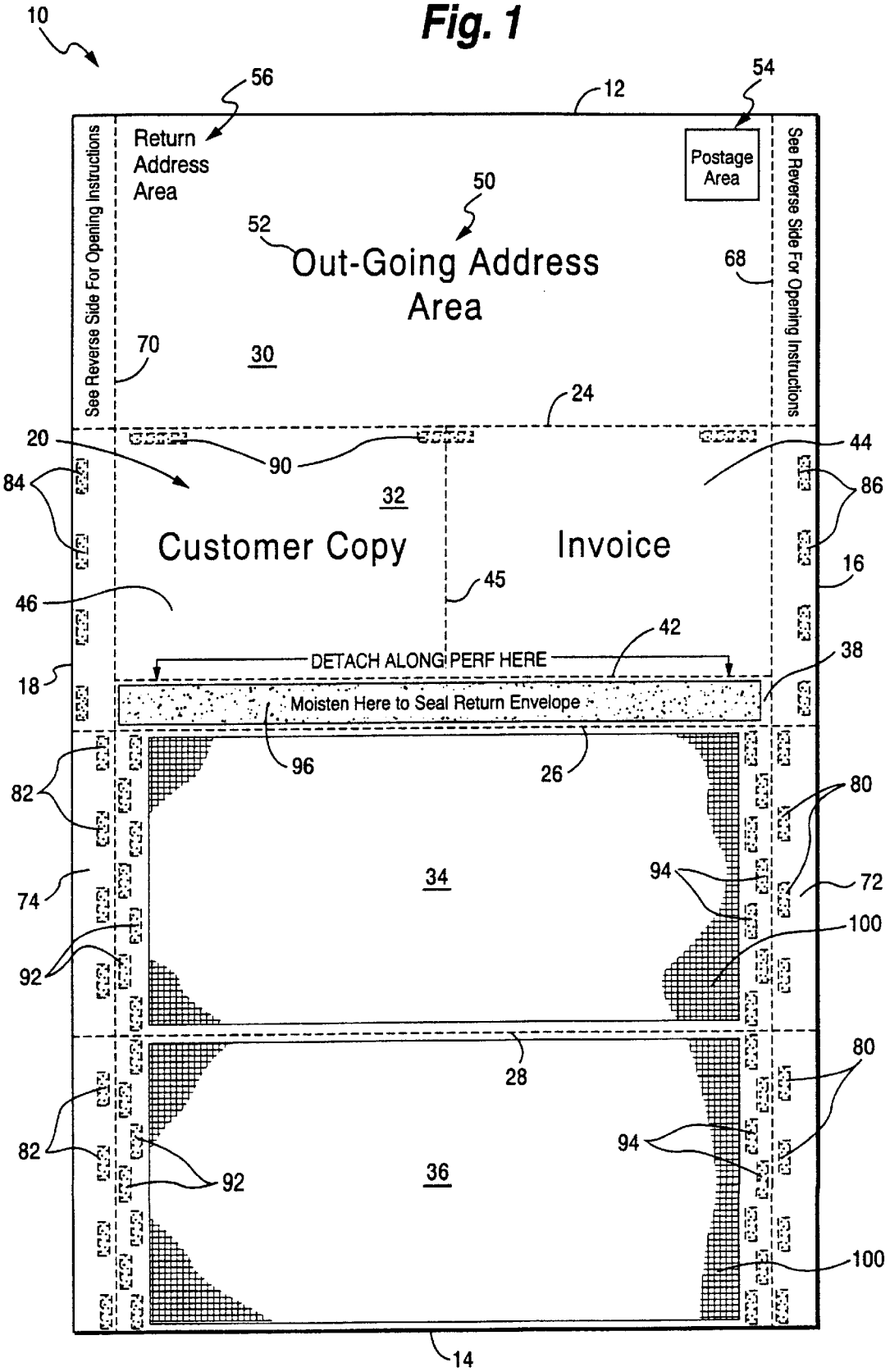
FIG. 1 is a plan view of a first face of an exemplary intermediate according to the present invention.
Figure 2:
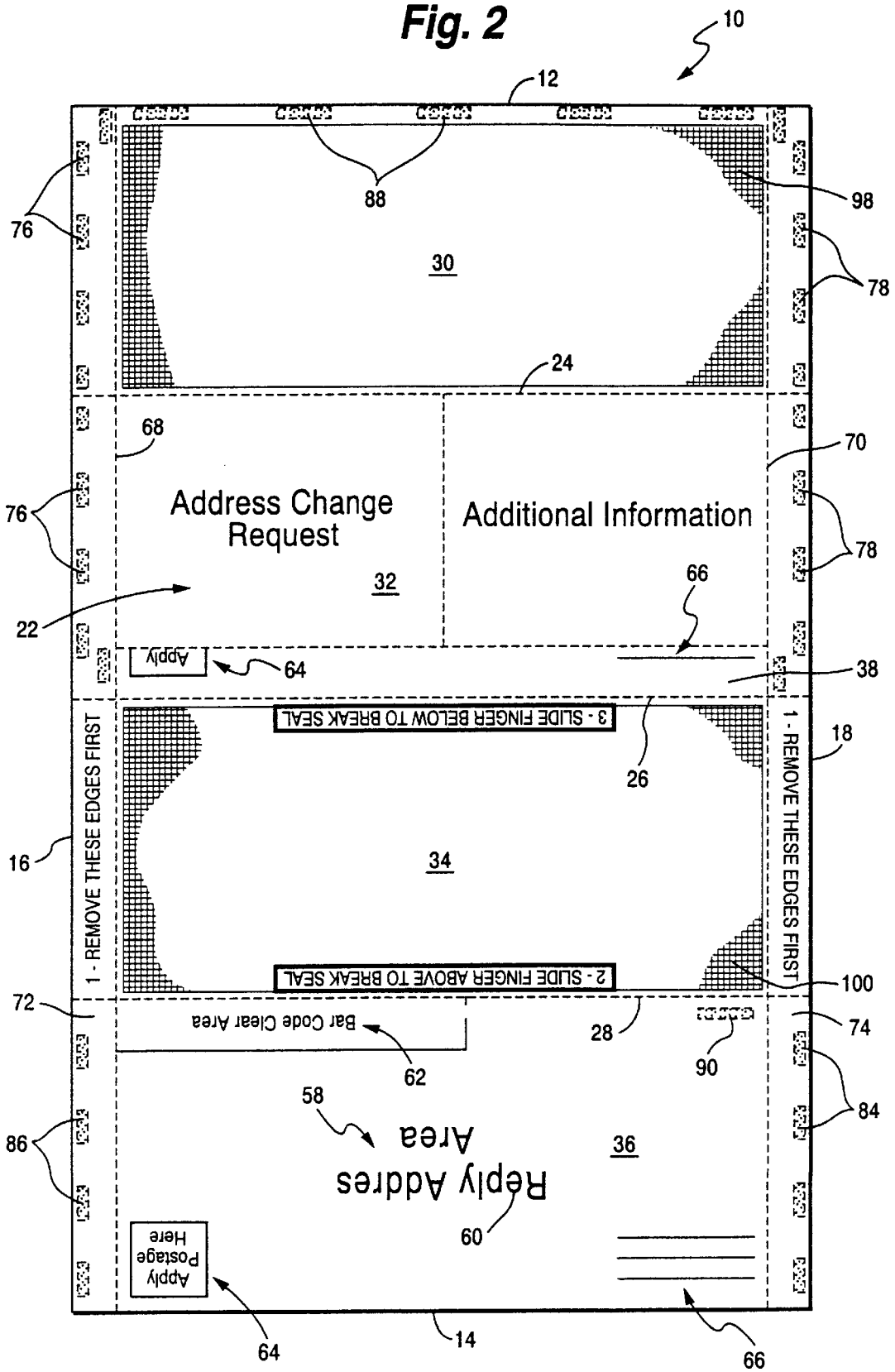
FIG. 2 is a plan view of the second face of the intermediate of FIG. 1.

An exemplary intermediate for a mailer type business form is shown generally by reference number 10 in FIGS. 1 and 2. It includes a quadrate sheet of substantially opaque paper (i.e., no windows and not fully translucent) having parallel top and bottom edges 12,14 and parallel first and second side edges 16,18, respectively. The side edges are perpendicular to the top and bottom edges. The sheet is further defined to include first and second faces 20,22 (FIG. 1 and FIG. 2), respectively. First, second and third fold lines 24,26,28 are provided parallel to the top and bottom edges dividing the sheet of the intermediate into four substantially three-equal size panels 30,32,34,36.

With reference to the presently preferred, illustrated embodiment, the first panel 30 is disposed as the top panel of the form, the second panel 32 is disposed as the first of two intermediate panels, the third panel 34 is disposed as the second of two intermediate panels and the fourth panel 36 is disposed as the bottom panel of the form so that the second and third panels are between the first and fourth panels. Thus, the first panel 30 is between the top edge 12 and the first fold line 24, the second panel 32 is between fold lines 24 and 26, the third panel 34 is between fold lines 26 and 28, and the fourth panel 36 is between fold lines 28 and the bottom edge 14 of the intermediate 10. Fold lines 24,26,28 may comprise lines of weakness such as perforation lines or die cut lines or may merely be scored or crease lines. In the presently preferred embodiment, where the second panel 32 is adapted to be removed and retained by the end user, fold line 24 is preferably lines of weakness that facilitates separation of the second panel from the first panel. Furthermore, the second fold line 26 defines the fold line for the sealing flap 38 of the reply envelope 40 and thus desirably is not easily detached from the remainder of the mailer. Instead, the parallel perforated line 42 of the second panel is adapted to facilitate the detachment of the invoice portion, which in the illustrated embodiment is comprised of two parts 44, 46 defined by right angle line of weakness 45, from the reply envelope portion of the mailer, as described in greater detail below. In the presently preferred embodiment, the third and fourth panels 34,36 together define the reply envelope and therefore, the third fold line 28 need not be adapted to be severed by the end user. As will become apparent below, the invention is not limited to the described series and orientation of the panels, except as required by the appended claims.

The intermediate also includes an outgoing address area 50 on the first face 20 of the first panel 30. The outgoing address area is of a size and defined by a media to receive e.g., a laser printed address or preprinted address label. The outgoing address area can include indicia corners or other indicator such as a change in texture, tone or color of the paper to facilitate the determination of the proper location of the outgoing address. Such indicators, however, are not critical to the effective implementation of the invention. Human readable address indicia, as shown only schematically by indicia 52 in FIG. 1, is ultimately imaged on the intermediate such as after it has passed through the laser printer. Other human or machine readable indicia may also be preprinted on the first face 20 of the third panel, such as a postal address bar coding (not shown), indicia 54 for postage application and/or indicia 56 for the sender's return address.

The intermediate also defines a reply address area 58 on the second face 22 of the intermediate, that is the face opposite to the face having the outgoing address area, but in the region defined by the fourth panel 36. The reply address area is of a size and media suitable for receiving human readable address indicia. Again, corner indicia or other print area designators, as described above with reference to the outgoing address area, may be provided to indicate the most preferred location of the reply address. In the presently preferred embodiment, the reply address indicia is preprinted in the reply address area but the indicia may be variably printed thereon or applied as a preprinted address label without departing from the concept of the invention. Thus, at some point, human readable reply address indicia shown schematically at 60 in FIG. 2 is imaged in the reply address area 58. Other human or machine readable indicia may also be preprinted on the second face 22 of the second panel 32, such as a postal address bar coding in bar code area 62, indicia 64 for postal stamp application and/or indicia 66, such as blank lines, for the end user to apply their own return address to the reply envelope. As described below, in the illustrated embodiment, sealing flap 38 is adhered to the top of the front face of the reply envelope. Therefore, at least partial indicia 64 and/or partial indicia 66 may be provided on the second face 22 of flap 38, as illustrated in FIG. 2, to alert the end user to the need for and proper location for postage and return address information on the reply envelope. Of course, where flap 38 is relatively large, indicia 64, 66 may be provided entirely on flap 38, and where flap 38 is minimized, the indicia 64, 66 may be provided entirely on panel 36. Or this indicia 64, 66 may be omitted entirely.

Figure 4:
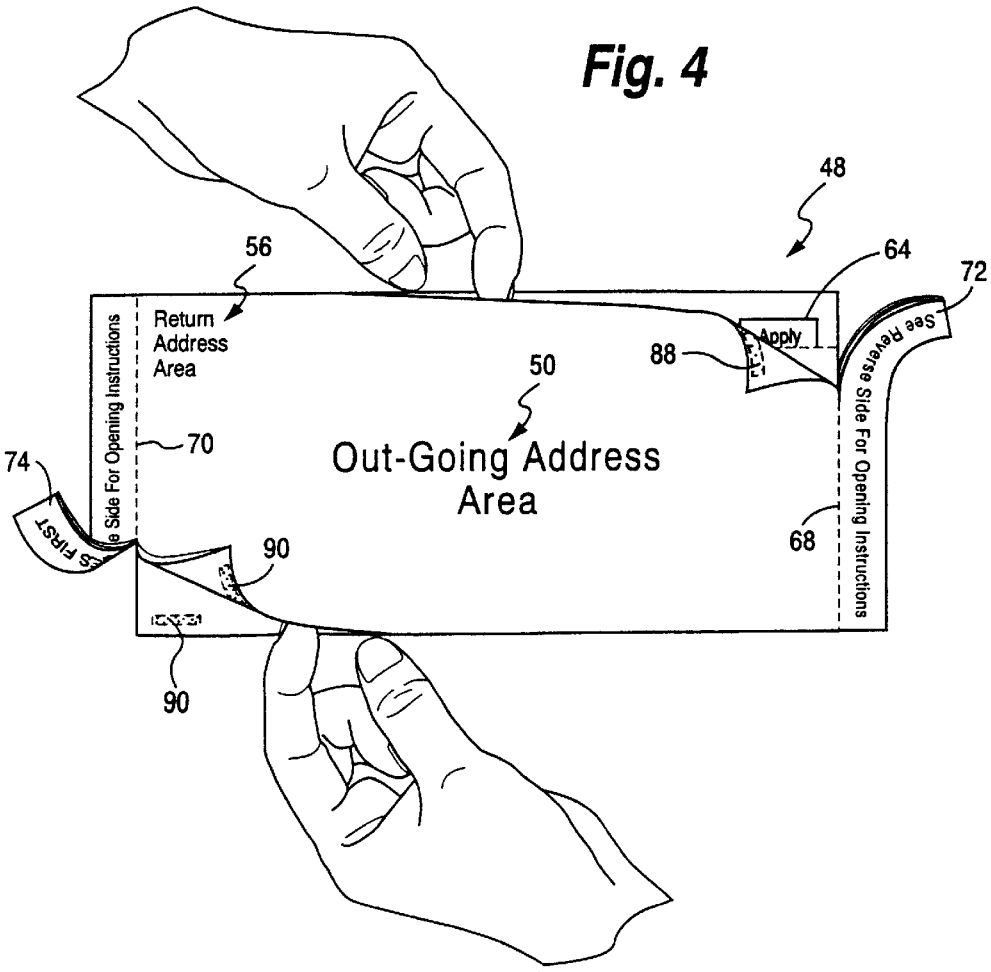
FIG. 4 is a perspective view showing the opening of the mailer of FIG. 3 by the end user.

First and second lines of weakness 68, 70 are formed in the first through fourth panels parallel to and spaced from the side edges 16, 18. The first and second lines of weakness define tear off strips 72, 74 providing for ready opening of a mailer 48 constructed by Z-folding the sheet of the intermediate about fold lines 24, 26, 28, as shown in FIG. 4.

Figure 3:
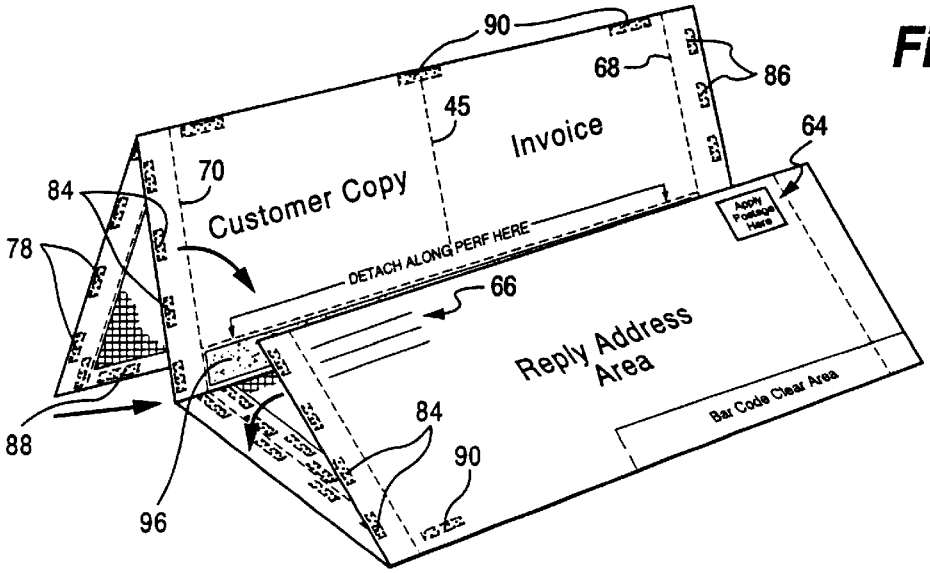
FIG. 3 is a perspective view from above showing the intermediate of FIGS. 1 and 2 being folded into a mailer type business form.

The intermediate comprises a first plurality of adhesive patterns provided in at least some of the tear off strips for holding the first through fourth panels together in the outgoing mailer configuration when the sheet is C-Z folded about the fold lines, as illustrated in FIG. 3. In the preferred embodiment, illustrated in the drawings, the adhesive patterns include discontinuous strips 76, 78 provided on the second face 22 of the first and second panels 30, 32 in tear off strips 72, 74, respectively, discontinuous strips 80, 82 provided on the first face 20 of the third and fourth panels 34, 36 in the tear off strips strips 72, 74, respectively, and discontinuous strips 84, 86 provided on the first face 20 of the second panel 32 and/or the second face 22 of the fourth panel 36 in the tear off strips 72, 74. As seen in FIGS. 1 and 2, preferably the respective strips 84,78 and 86,76 (second panel); and 80,84 and 82,84 (fourth panel), are longitudinally staggered and/or laterally offset from each other, as illustrated, so as to not overlap when the cut form intermediates 10 are stacked, which minimizes the potential for blocking.

The C-Z-fold adhesive patterns also preferably include one or more strips or segments for adhering the top and bottom edges of the Z-folded mailer. Thus, in the illustrated embodiment, pressure seal adhesive 88 is provided on the second face 22 adjacent the top edge 12 of the intermediate 10 (FIG. 2) and/or adjacent the second fold line 26 (not shown) to adhere the first and second panels 30, 32 in the Z-fold configuration and further adhesive segments 90 are provided on the first face 20 adjacent the first fold line 24 and/or on the fourth panel 36 second face 22 adjacent the third fold line 28 of the intermediate 10 to adhere the second and fourth panels in the Z-folded configuration after C-folding to form the reply envelope 40. Such adhesive patterns 88, 90 are preferably provided discontinuously on the respective edges of the first, second and/or third panels to facilitate disengagement of these edges by the end user with a letter opener or index finger, as shown in FIG. 4. The cohesive 90 provided for example on the second face 22 of the mailer is preferably limited, as shown, as that portion of the mailer intermediate is retained as a part of the reply envelope. Similarly, a portion of the cohesive 90 on the first face 20 is retained on a part of the statement in the illustrated embodiment and thus is preferably minimized in dimension.

Most preferably, the adhesive for adhering the intermediate in the C-Z-fold mailer configuration is a substantially permanent adhesive that is defined by pressure seal adhesive or cohesive for sealing the mailer upon folding and the application of suitable pressure to the adhesive regions. In the alternative, however, the adhesive may be a re-wettable adhesive, or pressure sensitive adhesive covered by a release strip. Also, the adhesive may be provided as continuous elements rather than discontinuous elements and/or in a pattern, shape or density other than that shown. Thus, the adhesive areas or patterns may take any configuration, not just dash line configuration as illustrated in FIGS. 1 and 2. However, it is preferred that the amount and spacing of such adhesive material be sufficient to allow the mailer 48 to be processed by U.S. postal service automated systems.

Figure 5:
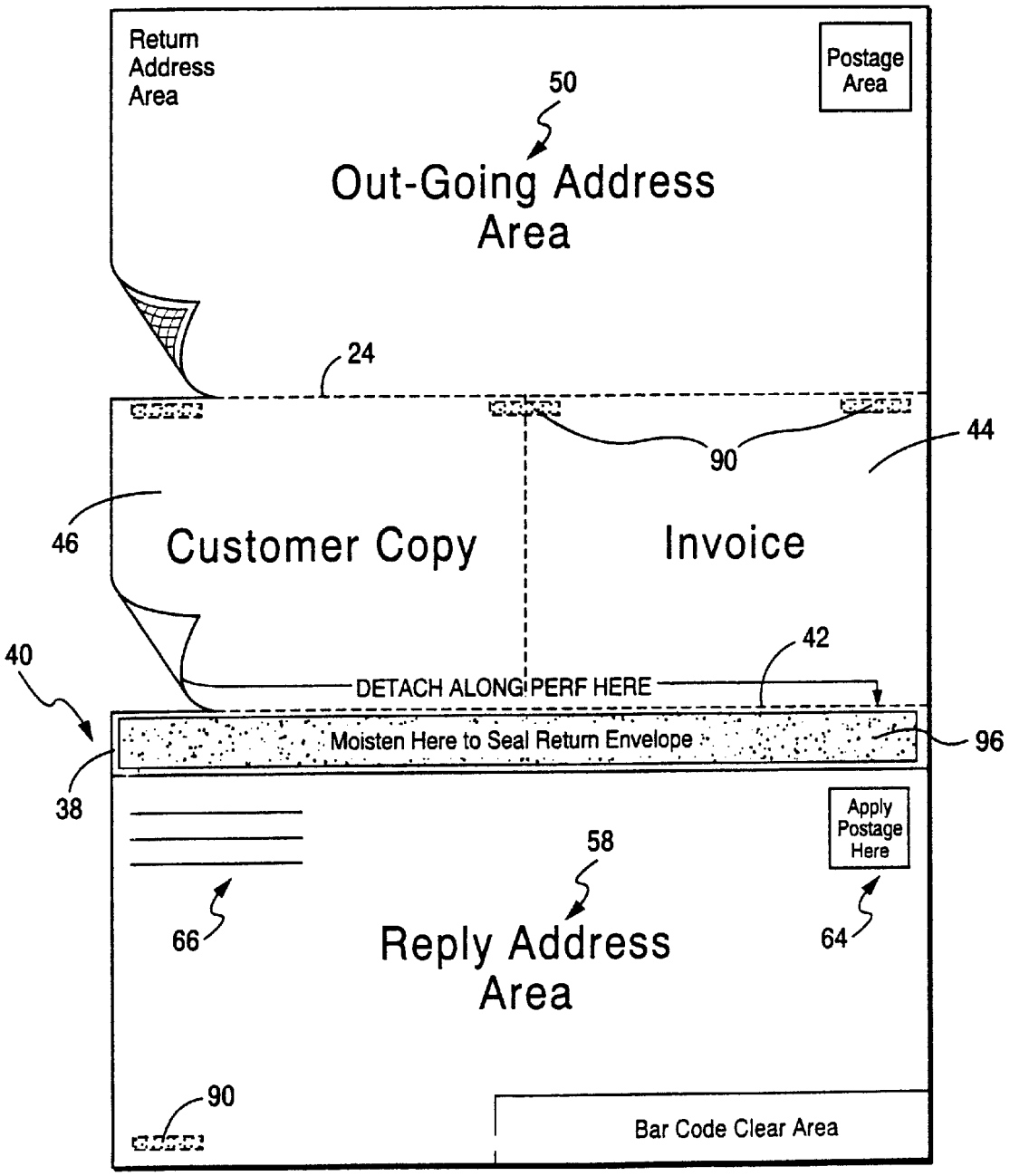
FIG. 5 is a plan view showing the removal of the statement or invoice according to an exemplary embodiment of the invention.

A plurality of adhesive patterns are further defined on the first face 20 of the intermediate to define two of the panels into a reply envelope. In the illustrated embodiment, the third and fourth panels are adapted to define the reply envelope (FIG. 5). Thus, an adhesive pattern comprised of adhesive areas 92, 94 is provided on the first face 20 of at least one of the third and fourth panels 34, 36. Because the third and fourth panels that define the reply envelope are joined at fold line 28, adhesive for defining the reply envelope is unnecessary along the third fold line 28.

Most preferably, the adhesive 92, 94 for adhering the third and fourth panels 34, 36 in the C folded return mailer/reply envelope configuration is a substantially permanent adhesive that is defined by pressure seal adhesive or cohesive for sealing the mailer upon folding and the application of suitable pressure to the adhesive regions. In the alternative, however, the adhesive may be a re-wettable adhesive, or pressure sensitive adhesive covered by a release strip. Also, the adhesive may be provided as continuous elements rather than discontinuous elements and/or in a pattern, shape or density other than that shown. Thus, the adhesive areas or patterns may take any configuration, not just dash line configuration as illustrated in FIGS. 1 and 2. However, it is preferred that the amount and spacing of such adhesive material be sufficient to allow the reply envelope 40 to be processed by U.S. postal service automated systems.

The second panel 32 further comprises a reply envelope closing flap 38 having an activatable adhesive 96 on the first face 20 thereof for sealing the reply envelope. More specifically, line of weakness 42 is defined to extend to and between the first and second lines of weakness 68, 70 of the second panel 32. Line of weakness 42 may be a perforated line or die cut line or may be a scored or a crease line. In the illustrated embodiment, the adhesive 96 is provided on the first face 20 of the thus defined flap 38, to secure the reply envelope 40 in a sealed configuration.

Adhesive 96 may be a re-wettable adhesive or may be a pressure sensitive adhesive that is covered and protected prior to sealing the reply envelope by a removable liner or the like. Other alternatives such as a cohesive that adheres to a counterpart adhesive pattern provided on the second face 22 of the fourth panel 36 may be provided. The adhesive areas or patterns may have variations in composition and configuration as described above with respect to areas 76–94.

Indicia may be printed where ever desired although at least with respect to the first face 20 of the first panel 30 and the second face 22 of the fourth panel 36 the printed indicia is preferably limited to address and postal indicia and/or mailer opening instructions. Various indicia and information may be printed on the first face 20 of the second panel 32 to instruct the end user to complete the remittance advice, on the second face 22 of the first panel 30 to instruct the end user as to the detachment of the statement portion of the mailer, on the second face 22 of the second panel 32 for address change notification or other information and on the second face 22 of the third panel to instruct the end user on opening the Z-fold mailer. Other indicia may be provided as deemed necessary or desirable to instruct and direct the end user and/or as advertising, particularly on the second face 22 of the third panel. In the illustrated embodiment to maximize security, a block or pattern 98 is provided as by imaging or other preprinting on the second face 22 of the first panel 30. As shown in the illustrated embodiment, a block out pattern, schematically shown at 100, may also be provided on the first and second faces 20, 22 of the third panel 34 and on the first face 20 of the fourth panel 36. In the case of the first face 20 of the third and fourth panels, the blocker is provided in the area that will become the interior of the reply envelope 40 on C folding and, therefore, does not in any way limit or reduce otherwise available printable area.

Although not shown, detachable tractor drive strips may be provided for the intermediate during processing. Such strips are conventional for facilitating handling of the intermediate for printing or the like during manufacture of the mailer. Such strips are typically provided where the intermediate is in continuous form, wherein the top and bottom edges are lines of weakness between longitudinally adjacent intermediates. During normal processing, such strips (not shown) are slit off at an appropriate stage to expose the side edges.

In constructing the mailer, after the intermediate is detached from the adjacent intermediates continuously printed therewith (if any) and after slitting of any tractor drive edges (if provided), the intermediate is C and then Z-folded as illustrated in FIG. 3 (typically by conventional folding equipment) and then is run through a suitable sealing machine (typically conventional equipment for either heat sealing or pressure sealing) for activating the adhesive patterns. Typically, the intermediate as seen in FIGS. 1 and 2 has a length between top and bottom edges of at least about 14 inches to ensure that all postal specifications are met by both the mailer and the reply envelope. The reply envelope in the illustrated embodiment has a width of about 7½ inches so that it can easily receive a standard (6 inch in length) check therein without folding. In the illustrated embodiment, each panel has a length of about 3½ inches and the reply envelope desirably has a flap having a length of about ½ inch to 1 inch and most preferably about 9/16, inch so that the reply envelope, having dimensions of 7½"×3½", accommodates both the transverse dimension of a full size check therein and meets postal regulations.

When the outgoing addressee receives the mailer, the panels then comprise first, second, third, fourth plies or panels with the second face 22 of the first panel 30 in face to face relation with the second face 22 of the second panel 32, the first face 20 of the second panel 32 in face to face relation with the bottom or second face 22 of the fourth panel 36 and the first face 20 of the fourth panel 36 in face to face relation with the first face 20 of the third panel 34. The mailer can be easily opened, as illustrated in FIG. 4, by tearing along lines of weakness 68, 70 and by disrupting the adhesive 88, 90 along the top and bottom edges of the mailer with an index finger. The resultant opened mailer is illustrated in FIG. 5. Ultimately, the statement portion 44, 46 is separated along line 42 as shown in FIG. 5. Once the remittance stub has been completed, the check comprising the remittance is inserted with the remittance stub into the formed reply envelope 40. The completed and filled reply envelope is then sealed by activating the adhesive 96, e.g., by wetting or removing a release strip (not shown), and applying the flap to the front panel of the reply envelope 40.

The intermediate and mailer according to the present invention have a number of advantageous characteristics. All address and postal markings from the original outgoing envelope are omitted in the reply by being detached from the mailer. The reply envelope offers all needed postal encoding for fast delivery and can be printer variable if duplex printing is selected. The design is compact and easy to produce and store using all presently available sealing technology. The reply envelope size allows for the remittance check to be inserted without folding and the removable panel 32 may comprise a variety of information including customer invoice copy, discount coupons, or other suitable elements.

It will thus be seen that according to the present invention, a simple and easy to construct, print, and utilize mailer has been provided having a large area available for printable data and a reply envelope which can accept a six inch personal check without folding, and without the need for a window or a patch. The reply envelope flap also folds to the back of the reply envelope as is most desirable for ease of use and aesthetics.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An intermediate for a mailer type business form, composing:

a quadrate sheet of paper having parallel top and bottom edges, parallel first and second side edges perpendicular to the top and bottom edges, and first and second faces;

first, second and third fold lines parallel to said top and bottom edges, and dividing said sheet into substantially equal size first, second, third and fourth panels, an outgoing address area being defined on said first face of said first panel, said outgoing address area being spaced from said first and second side edges;

a reply address area being defined on said second face of said fourth panel, said reply address area being spaced from said first and second side edges;

an invoice and/or area being defined on said first face of said second panel;

first and second lines of weakness formed in said first, second, third, and fourth panels, respectively, parallel to and spaced from each of said first and second side edges, said first and second lines of weakness defining tear-off strips providing for ready opening of a mailer constructed by folding said sheet about said fold lines;

first adhesive areas provided in at least some of said tear-off strips for holding said first through fourth panels together as an outgoing mailer when said sheet is folded about said fold lines; and second adhesive areas provided on said first face of said third and/or fourth panel for defining said third and fourth panels into a reply envelope that is substantially sealed along first and second side edges thereof.

2. An intermediate as recited in claim 1, wherein a reply envelope closing flap is formed on said second panel, and having a third adhesive area on said first face thereof for sealing the reply envelope along a top edge thereof.

3. An intermediate as recited in claim 2, wherein said first panel is disposed between said top edge and said first fold line, said fourth panel is disposed between said bottom edge and said third fold line, and said second and third panels are disposed between said first and fourth panels.

4. An intermediate as recited in claim 3 wherein said first fold line is a line of weakness.

5. An intermediate as recited in claim 3, wherein said first adhesive areas further include strips of adhesive disposed on said first face of said second panel adjacent said first fold line.

6. An intermediate as recited in claim 2, wherein said reply envelope closing flap is defined by a third line of weakness formed in said second panel to and between said first and second lines of weakness.

7. An intermediate as recited in claim 1, wherein said first adhesive areas comprise permanent adhesive.

8. An intermediate as recited in claim 1, wherein said third adhesive area comprises a rewettable adhesive.

9. An intermediate as recited in claim 1, wherein said second adhesive areas comprise a permanent adhesive.

10. An intermediate as recited in claim 1 wherein the longest dimension of the interior of the reply envelope formed from said intermediate is at least about six inches, so that the reply envelope can receive an unfolded bank check therein.

11. An intermediate as recited in claim 1 further comprising human readable address indicia imaged in said outgoing address area.

12. An intermediate as recited in claim 1 wherein the distance between said top and bottom edges of the unfolded sheet is about fourteen inches.

13. An intermediate for a mailer type business form, composing:

a quadrate sheet of paper having parallel top and bottom edges, parallel first and second side edges perpendicular to the top and bottom edges, and first and second faces;

first, second and third fold lines parallel to said top and bottom edges, and dividing said sheet into substantially equal size first, second, third and fourth panels, said first panel is disposed between said top edge and said first fold line, said fourth panel is disposed between said bottom edge and said third fold line, and said second and third panels are disposed between said first and fourth panels;

an outgoing address area being defined on said first face of said first panel, said outgoing address area being spaced from said first and second side edges;

a reply address area being defined on said second face of said fourth panel, said reply address area being spaced from said first and second side edges;

an invoice and/or area being defined on said first face of said second panel;

first and second lines of weakness formed in said first, second, third, and fourth panels, respectively, parallel to and spaced from each of said first and second side edges, said first and second lines of weakness defining tear-off strips providing for ready opening of a mailer constructed by folding said sheet about said fold lines;

a third line of weakness formed in said second panel extending tow and between said first and second lines of weakness, in parallel to said second fold line;

first adhesive areas provided in at least some of said tear-off strips for holding said first through fourth panels together as an outgoing mailer when said sheet is folded about said fold lines;

second adhesive areas provided on said first face of said third and/or fourth panel for defining said third and fourth panels into a reply envelope that is substantially sealed along first and second side edges thereof; and a third adhesive area on said first face of said reply envelope closing flap for sealing the reply envelope along a top edge thereof.

14. An intermediate as recited in claim 13, wherein said first adhesive areas further include strips of adhesive disposed on said first face of said second panel adjacent said first fold line.

* * * * *